US005341947A

United States Patent [19]

Rossé et al.

[11] Patent Number: 5,341,947

[45] Date of Patent: Aug. 30, 1994

[54] TAMPER-EVIDENT DEVICE FOR CONTAINER CLOSURES

[75] Inventors: Meinrad Rossé, La Tour-De-Peilz; Jean Servaux, Chavornay, both of Switzerland

[73] Assignee: Nestec S.A., Vevey, Switzerland

[21] Appl. No.: 750,099

[22] Filed: Aug. 26, 1991

[30] Foreign Application Priority Data

Sep. 12, 1990 [CH] Switzerland ..... 2957/90

[51] Int. Cl.[5] ..... B65D 41/32

[52] U.S. Cl. ..... 215/230; 215/250; 215/270

[58] Field of Search ..... 215/230, 250, 253, 270, 215/271, 220; 220/257, 265, 266, 281

[56] References Cited

U.S. PATENT DOCUMENTS

| | | | |
|---|---|---|---|
| 1,595,614 | 8/1926 | Pease | 215/230 |
| 2,066,390 | 1/1937 | Cahoon et al. | 215/253 |
| 3,460,701 | 8/1969 | Powalowski et al. | 215/253 X |
| 3,656,648 | 4/1972 | Powaloski et al. | 215/253 |
| 3,710,970 | 1/1973 | Elfline | 215/215 |
| 3,736,899 | 6/1973 | Manske | 215/230 X |
| 3,866,782 | 2/1975 | Westfall | 215/253 |
| 4,371,088 | 2/1983 | Gach | 215/220 |
| 4,378,894 | 4/1983 | Willis et al. | 215/252 |
| 4,527,701 | 7/1985 | Schaubeck | 215/220 |
| 4,533,059 | 8/1985 | Kapolas et al. | 215/230 |
| 4,669,620 | 6/1987 | Coifman | 215/220 |
| 4,678,082 | 7/1987 | Fillmore | 215/230 X |
| 4,721,219 | 1/1988 | Dullabaun et al. | 215/274 |
| 4,765,498 | 8/1988 | Rafferty | 215/230 |
| 4,801,029 | 1/1989 | Begley | 215/250 |
| 4,957,211 | 9/1990 | Ekrert et al. | 215/230 |

FOREIGN PATENT DOCUMENTS

| | | |
|---|---|---|
| 0257468 | 3/1988 | European Pat. Off. . |
| 8908757 | 1/1991 | France . |

*Primary Examiner*—Allan N. Shoap
*Assistant Examiner*—V. Caretto
*Attorney, Agent, or Firm*—Vogt & O'Donnell

[57] ABSTRACT

A tamper-evident device for application to a container closure cap has a ring element which surrounds an insert panel element. The insert panel element, which is centrally disposed with respect to the ring element, has an edge displaced from and surrounded by an edge of the ring element and is connected to the ring element by at least two lugs. The ring element of the device is bonded to an outer surface of a container closure cap which has a centrally positioned portion which is elastically deformable under the effects of changes in pressure so that when positioned on a rigid container which has an interior under a partial vacuum and upon opening and pressurization of the container, the deformable membrane lifts the insert panel element to break lugs connecting the ring and insert elements.

9 Claims, 2 Drawing Sheets

TAMPER-EVIDENT DEVICE FOR CONTAINER CLOSURES

BACKGROUND OF THE INVENTION

This invention relates to a rigid container under a residual vacuum which comprises a closure cap having a deformable central part.

There are already various tamper-evident systems in the food industry, for example systems in which a strip of paper is glued to the closure cover and the top of the container accommodating the food product. The reason for the development of such systems is to stop the packs being opened by dishonest people seeking either deliberately to compromise the sterility of the pack or to add products unfit for human consumption. FR-PS 89 08 757 also relates to a tamper-evident system comprising a seal straddling the edge of the cover and the top of the glass containing the food product. The disadvantage of this system is that when the container is opened, the seal is broken, leaving a number of fragments which have to be quickly thrown away to ensure that they are not accidentally mixed with the food product itself.

SUMMARY OF THE INVENTION

The present invention provides a tamper-evident device for container closures which comprises a ring element, an insert panel element, which is centrally disposed with respect to the ring element and which has an edge which is displaced from and surrounded by an edge of the ring element, and at least two lugs which connect the ring element and the insert panel element to provide the consumer with a clean, practical and easy-to-use tamper evident system that guarantees maximum security.

The tamper-evident device according to the invention may be based on any type of container comprising a closure cap with a central, elastically deformable membrane.

The present invention also relates to a rigid container under a residual vacuum comprising a closure cap with a deformable central part and a tamper-evident device comprising a ring element integral with the closure cap and a central one-piece insert panel element connected to the ring by at least two connecting lugs, at least one of the lugs breaking the insert panel element and separating from the ring when the closure cap is opened. The closure cap may be comprised of metal.

DETAILED DESCRIPTION OF THE INVENTION

In accordance with the present invention, the rigid container with its closure cap having the deformable central part is a container accommodating a food product which has been subjected to an operation to create a residual vacuum inside the container. The residual vacuum causes the concave deformation of the central part of the cap. The residual vacuum is created, for example, by sterilization, pasteurization or hotfilling. Under the effect of cooling, a partial vacuum is created inside the container which causes the concave deformation of the central part of the cap. Upon breaking the partial vacuum, such as by unscrewing the closure cap, which restores the interior of the container to atmospheric pressure, the central part of the cap lifts automatically and thus separates the central insert panel element from the ring element fixed to the cap. The connecting lugs must, of course, be thick enough not to break during handling and thin enough for the deformation of the capsule to allow complete release of the insert panel element and its separation from the ring.

The ring is fixed to the closure cap by bonding. The adhesive used may be any state-of-the-art type. The central insert is connected to the ring element by at least two connecting lugs. However, there may also be a larger number of connecting lugs, for example from three to eight. The central insert panel element may be circular or any other shape providing its shape accommodates the presence of connecting lugs establishing the connection to the ring.

In one embodiment, one of the connecting lugs is stronger than the other two, such as by being thicker to enable a rocking effect to be obtained when the closure cap is opened.

In one embodiment, to ensure that the central insert panel bears against the central part of the closure cap, a compensating bead is provided on that side of the central insert panel element facing the closure cap. In addition, this bead also saves material for the insert. The tamper-evident device is made from polystyrene or any other breakable plastic material either by injection or by molding.

The invention is described in more detail in the following with reference to the accompanying drawings.

DETAILED DESCRIPTION OF THE DRAWINGS

Figure 1:
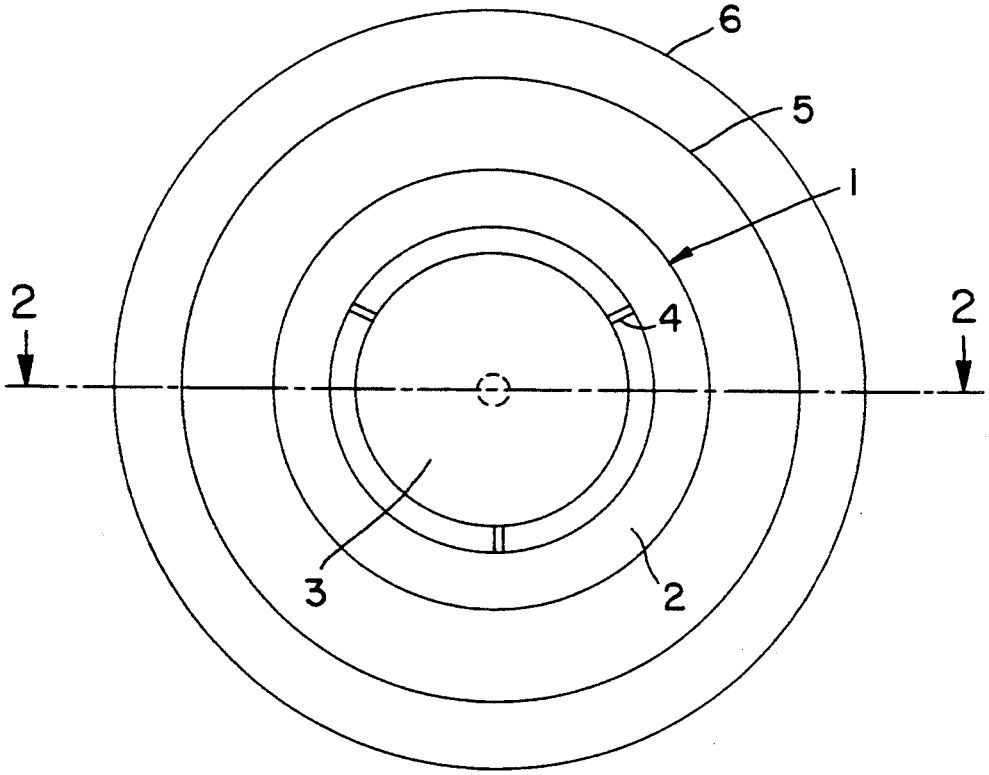
FIG. 1 is a plan view of the container with the tamper-evident system according to the invention.
Figure 2:
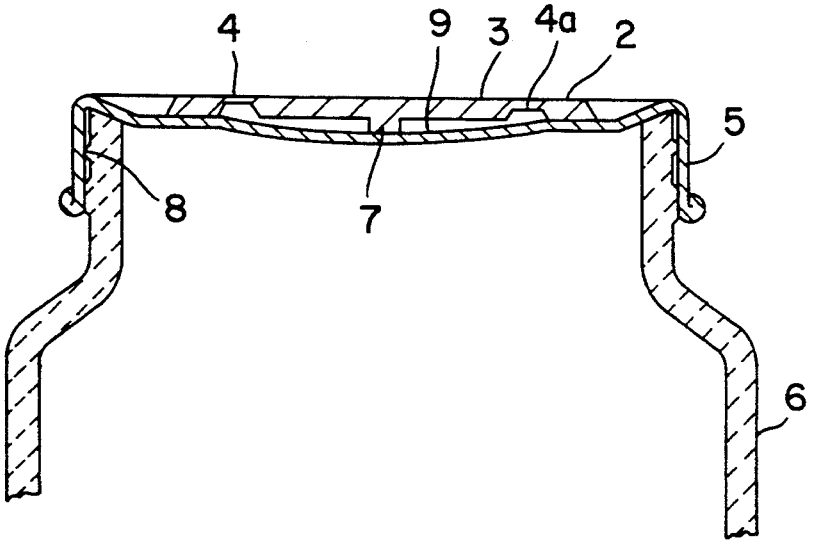
FIG. 2 is a section on the line 2—2 of FIG. 1.
Figure 3:
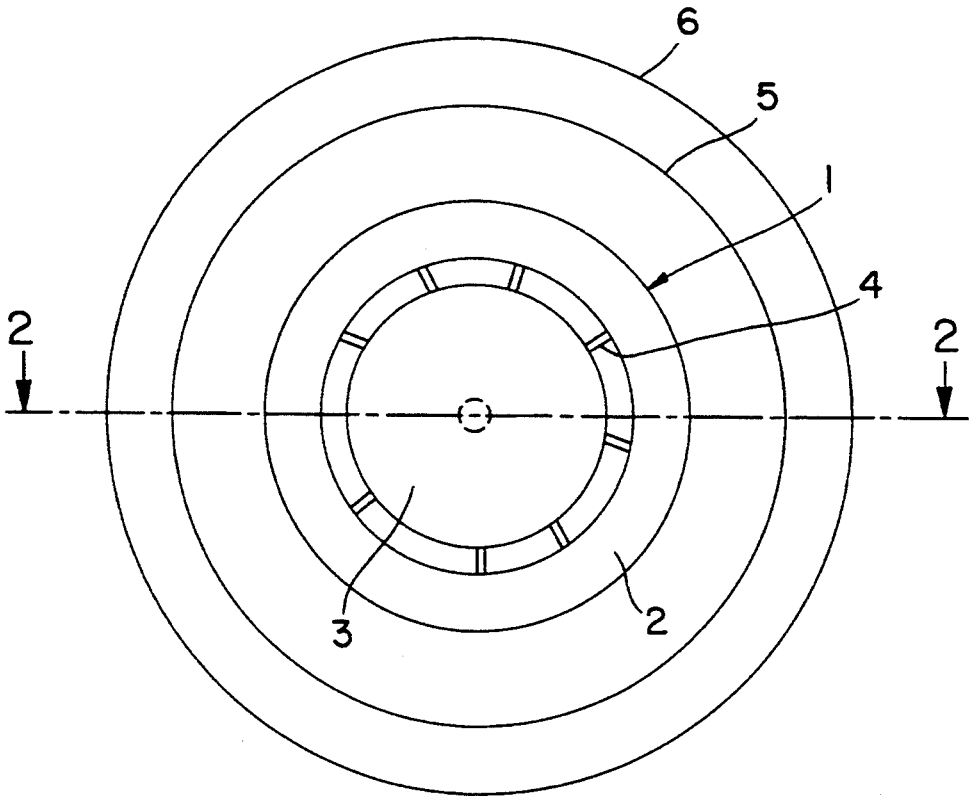
FIG. 3 is a plan view of the container with a tamper-evident system which has eight connecting lugs.

As illustrated in FIGS. 1 and 2, the tamper-evident device of the present invention has a ring element (2) and a centrally disposed insert panel element (3) having an edge displaced from and surrounded by an edge of the ring element. As illustrated, three lugs (4) connect the insert panel element to the ring element. As illustrated in FIG. 2, lug (4*a*) is thicker than the other lugs. As also illustrated, a bead element (7) is centrally disposed with respect to and protrudes from insert panel element (3). As also may be seen from FIG. 2, closure cap (5) closes the end opening of the container (6). The tamper-evident device (1) is positioned on the face of the closure cap surface which opposes the interior of the container.

The container (6) is closed by cap (5) to which is bonded the tamper-evident device (1) comprising the ring element (2) and a central insert element (3) connected to the ring element by three connecting lugs (4). The cap (5) is screwed onto the upper end of the container (6) via bosses (8) and, since the container is sterilized, the cap is curved towards the interior of the container. When the container is opened, the membrane (9) of the cap (5) applies pressure to the compensating bead element (7) so that the connecting lugs (4) break, thus releasing the central insert element (3).

We claim:

1. A tamper-evident container having an interior maintained under a partial vacuum comprising:

a container, which is rigid under a partial vacuum and which has an opening, and a closure cap which closes the container opening to keep an interior of the container under a partial vacuum, which has a cap portion having a container interior closing surface which covers the container opening and which is opposed by an outer cap surface and which has a central portion which is elastically deformable under effects of changes in pressure; and a tamper-evident device positioned on the closure cap outer surface which comprises a ring element bonded to the cap outer surface, an insert panel element, the insert panel element being centrally disposed with respect to the ring element and having an edge displaced from and surrounded by an edge of the ring element, and at least two lugs which connect the ring element and the insert panel element so that upon opening and pressurization of the container, the deformable cap portion lifts the insert panel element so that at least one of the lugs connecting the ring and insert element breaks.

2. A container according to claim 1 further comprising a bead element centrally disposed with respect to and protruding from the insert panel element towards the cap deformable portion.

3. A container according to claim 1 or 2 wherein there are from 3 to 8 lugs.

4. A container according to claim 3 wherein one lug has a thickness greater than the other lugs.

5. A container according to claim 1 or 2 wherein there are 3 lugs.

6. A container according to claim 1 or 2 wherein one lug has a thickness greater than the other lugs.

7. A container according to claim 1 wherein the device is comprised of polystyrene.

8. A container according to claim 1 wherein the cap is comprised of metal.

9. A container according to claim 1 or 2 wherein upon opening and pressurization of the container and lifting of the insert panel element, all of the lugs break.

* * * * *

UNITED STATES PATENT AND TRADEMARK OFFICE

CERTIFICATE OF CORRECTION

PATENT NO. : 5,341,947

DATED : August 30, 1994

INVENTOR(S) : Meinrad ROSSE, et al.

It is certified that error appears in the above-indentified patent and that said Letters Patent is hereby corrected as shown below:

Column 1, line 46, after "breaking", insert --and--.

Column 3, line 19 (line 24 of claim 14), "element" should be --elements--.

Signed and Sealed this

Thirteenth Day of December, 1994

*Attest:*

*Attesting Officer*

BRUCE LEHMAN

*Commissioner of Patents and Trademarks*